US005697334A

United States Patent [19]

Below

[11] Patent Number: 5,697,334

[45] Date of Patent: Dec. 16, 1997

[54] SPARK PLUG WITH INTEGRAL RETAINER NUT

[75] Inventor: Matthew B. Below, Findlay, Ohio

[73] Assignee: AlliedSignal Inc., Morristown, N.J.

[21] Appl. No.: 603,004

[22] Filed: Feb. 16, 1996

[51] Int. Cl.[6] ..... H01T 13/08

[52] U.S. Cl. ..... 123/169 R; 313/137; 313/143; 313/144; 445/7

[58] Field of Search ..... 123/169 EL, 169 E, 123/169 PH, 169 MG, 169 R; 313/118, 134, 136, 138, 141, 143

[56] References Cited

U.S. PATENT DOCUMENTS

| | | | |
|---|---|---|---|
| 2,944,178 | 7/1960 | Schaub | 313/118 |
| 4,730,582 | 3/1988 | Linsay | 123/169 MG |
| 4,901,688 | 2/1990 | Kashiwara et al. | 123/169 EL |
| 4,989,557 | 2/1991 | Penney | 123/169 EL |
| 5,014,656 | 5/1991 | Leptich et al. | 123/169 EL |
| 5,091,672 | 2/1992 | Below | 313/143 |
| 5,258,684 | 11/1993 | Matesco | 313/141 |

*Primary Examiner*—Andrew M. Dolinar
*Assistant Examiner*—Hieu T. Vo
*Attorney, Agent, or Firm*—Howard G. Massung

[57] ABSTRACT

A spark plug (11) having a center conductive path (21) with a cylindrical body having a tip (33, 51, 77) at one end and a terminal (23) near the other end has an insulator (41, 45) radially surrounding the center electrode and a substantially cylindrical body with at least first and second diameter sections separated by a shoulder (29). A ground shield (37) surrounds the insulator first diameter section and including near one end a frustoconical section (31) juxtaposed with the insulator shoulder. There is a ground electrode (55, 57, 73) near the other end having a portion thereof (53, 75) aligned with the center electrode tip to form a spark gap. An annular retainer (59) surrounds the insulator second diameter section and including a threaded portion (61) threadedly engaging the threaded portion (17) of a generally cylindrical opening in the head of an internal combustion engine. The retainer includes a frustoconical portion (63) overlapping the ground shield frustoconical section and juxtaposed insulator shoulder securing the ground shield and retainer together with the insulator captured therebetween. The annular retainer has a sidewall thickness in the region of the threaded portion which is substantially greater than the sidewall thickness in the region overlapping the ground shield.

22 Claims, 2 Drawing Sheets

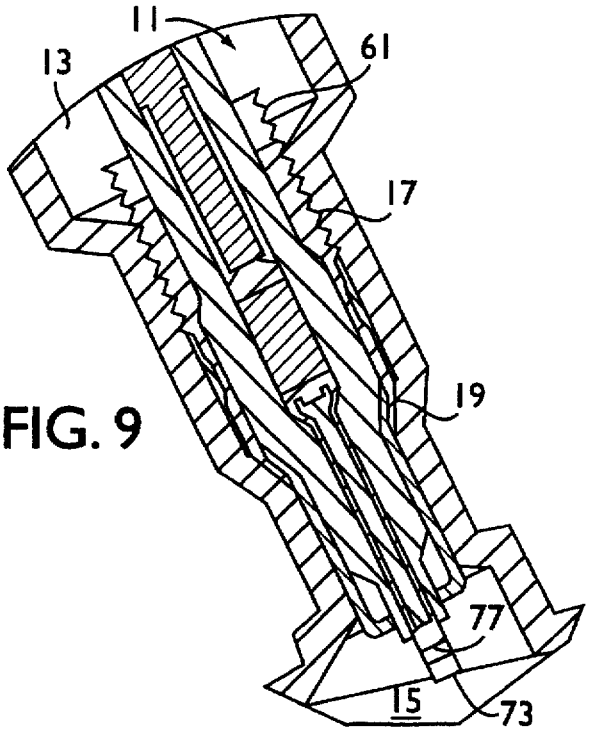
FIG. 9
FIG. 10
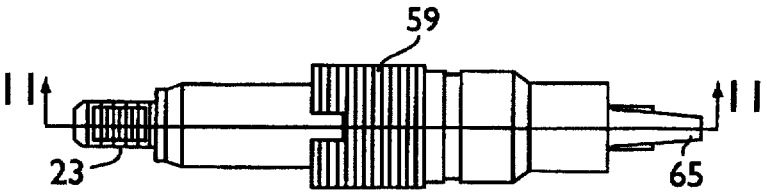
FIG. 11
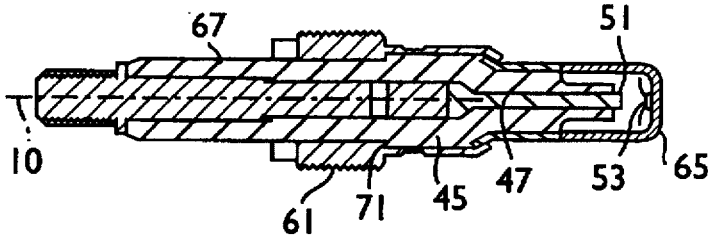
FIG. 7
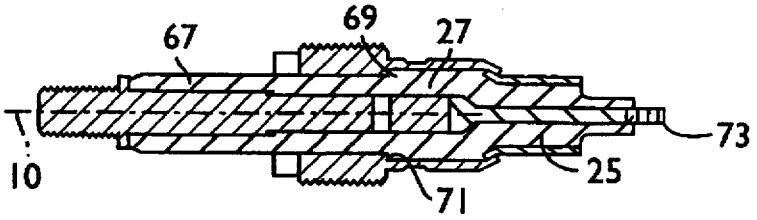
FIG. 8
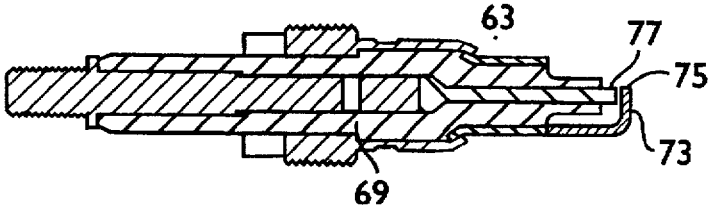

SPARK PLUG WITH INTEGRAL RETAINER NUT

The present invention relates generally to methods and apparatus for positioning spark gaps in the combustion chamber of internal combustion engines and more particularly to a spark plug having a shield including an annular seat for sealingly seating in the head of such an engine and an annular retainer nut formed as an integral part of the plug with the seat located axially intermediate the gap and the nut.

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug wire attaches. An "L" shaped ground electrode extends from one edge of the threaded end of the metal casing into axial alignment with the central electrode. The force applied to seal the spark plug in the head is the result of torque transmitted by the threaded metal casing, hence, the threaded portion of the metal casing must be sturdy and of substantial size.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and a decrease in the combustion chamber wall area available to threadedly receive the spark plug.

The decrease in the inside diameter of the metal bore of the spark plug reduces the ability of the spark plug to resist carbon build up and similar deposits reducing ignition efficiency. U.S. Pat. No. 5,091,672 discloses a spark plug which attenuates the deleterious effect of reducing the spark plug size by providing a spark plug having an insulator with a cylindrical body that surrounds a central electrode. The cylindrical body has a first diameter section separated from a second diameter section by a shoulder. A sleeve that surrounds the second diameter has an integral base that is positioned a fixed distance from the tip to the center electrode by the engagement of a flange on the sleeve with a shoulder on the cylindrical body. A radial tab that extends from the sleeve is aligned through a slot in the head to establish uniform positioning of the ground electrode. A separate end or retainer nut surrounds the first diameter and engages the flange to locate and position the spark plug within the combustion chamber. Uniform positioning of an L-shaped ground electrode within the combustion chamber is also disclosed in U.S. Pat. No. 4,989,557 to Penny.

U.S. Pat. No. 5,091,672 which represents the point of departure for the present invention is specifically incorporated herein by reference.

While the specific details with respect to structure achieves its salutary goals, it suffers from some drawbacks. Prolonged operation results in the accumulation of carbon and other combustion residue between the sleeve and the cylindrical bore or opening in the head which receives the spark plug. When removing the spark plug, the retainer nut is unscrewed from its threaded engagement with the head and then the spark plug body (insulator, sleeve and electrodes) is removed. Such removal is typically accomplished by grasping the terminal end of the spark plug, either by hand or with pliers or a similar tool to pull the spark plug from the bore. If the motion of withdrawing the spark plug body from the head is not coaxial with the bore in the head, and it rarely is, the sleeve binds against the closely surrounding deposits making spark plug removal very difficult. Additionally, the separate retainer represents an additional part for each engine cylinder which may become lost or misplaced. Finally, in the highly competitive spark plug market, any reduction in manufacturing cost is highly desirable. U.S. Pat. Nos. 5,014,656 and 4,989,557 teach spark plug structures which exhibit similar deficiencies.

The present invention provides solutions to the above problems by providing a unified spark plug body and retainer nut so that during removal of the spark plug, the shell seat moves away from the mating seat portion of the head bore in a helical pattern assuring continuous alignment of the shell and any surrounding carbon or other deposits. The spark plug seat moves away from the head axially while also moving radially as the spark plug nut is unscrewed and the entire spark plug structure is axially backed out the length of the retainer nut threads, thereby enhancing ease of removal of the spark plug. Moreover, the present invention achieves these solutions while retaining many of the advantageous features of the earlier patent such as minimizing the likelihood of cross-threading of the retaining nut within the cylinder head.

In accordance with another form of the invention, a spark plug is located in a generally cylindrical opening or bore which communicates with a combustion chamber of an internal combustion engine. The opening has a threaded portion and a generally frustoconical seat portion. The spark plug includes a center electrode having a cylindrical body with a tip at one end and a terminal near the other end. An insulator which radially surrounds the center electrode has a substantially cylindrical body with at least first and second diameter sections separated by a shoulder. A ground shield which surrounds the insulator first diameter section has a frustoconical section juxtaposed with the insulator shoulder having near one end a ground electrode near the other end having a portion which is aligned with the center electrode tip to define therewith a spark gap. An annular retainer which surrounds the insulator second diameter section includes a threaded portion threadedly engaging the threaded portion of the bore and a frustoconical portion overlapping the ground shield frustoconical section and juxtaposed insulator shoulder securing the ground shield and retainer together with the insulator captured therebetween.

In accordance with another aspect of the invention, a radial spark gap is achieved in a spark plug generally of the type discussed by providing a ground shield which surrounds the insulator first diameter section and includes near one end a frustoconical section juxtaposed with an insulator shoulder and a ground electrode near the other end having a portion including a tip receiving centrally located aperture radially aligned with the center electrode tip and defining therewith a radial spark gap. Such a radial spark gap diminishes the advantages of uniform positioning of the ground electrode within the combustion chamber as taught in aforementioned patents. While radial gap spark plugs have been suggested in the past, they typically employ a central insulator which extends through the ground ring.

According to a further aspect of the invention, a spark plug of the type having a center electrode with a tip at one end and a terminal near the other end and an insulator radially surrounding the center electrode employs an insulator having a substantially cylindrical body with at least first and second diameter sections separated by a first shoulder, and second and third diameter sections separated by a second shoulder where the diameter of the second section is greater than the diameters of the first and third sections. Such a spark plug is advantageously assembled by axially passing a cylindrical shell ground shield of the type having a ground electrode near one end and a flared frustoconical flange near the other over the first diameter section to engage the flared frustoconical flange with the first shoulder. Then, a cylindrical shell retainer of the type having an interior frustoconical ledge and exterior threads is axially passed over both the third and second diameter sections to engage the frustoconical ledge with the second shoulder. Finally, a portion of the retainer is radially collapsed about the flared frustoconical flange to secure the ground shield and retainer together with the insulator captured therebetween. In the case of a radial spark gap, the ground electrode includes a centrally located tip receiving aperture and the first mentioned step of axially passing includes moving the center electrode tip through the aperture to a position axially aligned with and radially spaced from the shield one end.

BRIEF DESCRIPTION OF THE DRAWING

FIGS. 7 and 8 are orthogonal cross-sectional views of a spark plug showing a still further form of the invention;

FIG. 9 illustrates a sectional view of the spark plug of FIGS. 7 and 8 seated in the bore of an internal combustion engine;

FIG. 10 is a side elevation view of the spark plug of FIG. 6; and

FIG. 11 is a view in cross-section along lines 11—11 of FIG. 10.

Corresponding reference characters indicate corresponding parts throughout the several views of the drawing.

DESCRIPTION OF THE PREFERRED EMBODIMENT

Figure 6:
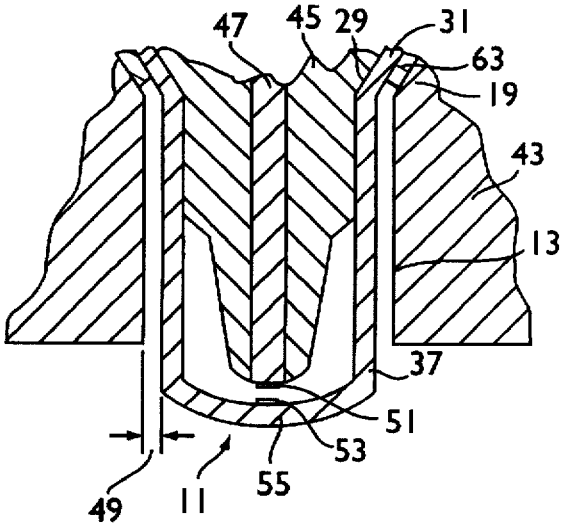
FIG. 6 is a cross-sectional view of a portion of a spark plug incorporating the invention in another form and received in the head of an internal combustion engine.

In FIGS. 6 and 9, a spark plug 11 is shown in a cylindrical bore or opening 13 which communicates with the combustion chamber 15 of an internal combustion engine. The opening has threads 17 for receiving the spark plug threads 61 and a frustoconical sealing seat 19.

FIGS. 1–5 illustrate a radial spark gap version of the present invention. The spark plug 11 has an axis 10 and a center conductive resistive path 21 extending the full axial length of the spark plug. The center conductor includes an electrode which has a cylindrical body with a tip 33 at one end and a terminal 23 near the other end. The tip 33 is a longer than conventional center wire 47. This increased length center wire 47 aids alignment and helps maintain close tolerances during manufacture of the spark plug 11. A ceramic or similar insulator 41 radially surrounds center electrode 21. The insulator has a substantially cylindrical body with first 25, second 27 and third 67 diameter sections. The second diameter section 27 is located intermediate the first 25 and third 67 diameter sections while the diameter of the second diameter section 27 is greater than that of either of the other two diameter sections 25 and 67. The first 25 and second 27 dissimilar diameter sections are separated by a shoulder 29 while a shoulder 69 separates the second and third diameter sections.

Figure 1:
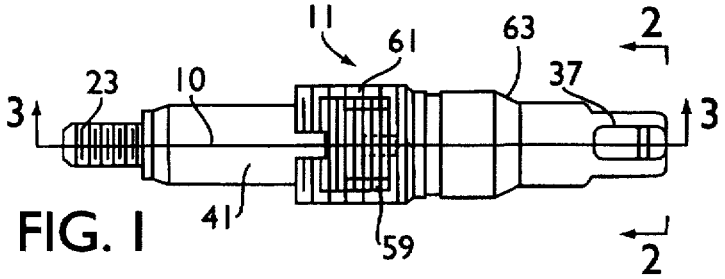
FIG. 1 is a side elevation view of a radial gap spark plug illustrating the invention in one form.
Figure 2:
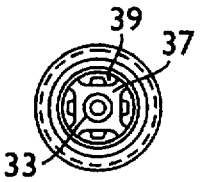
FIG. 2 is an end view of the spark plug of FIG. 1 taken from along lines 2—2 of FIG. 1, the right end thereof showing the radial spark gap.
Figure 3:
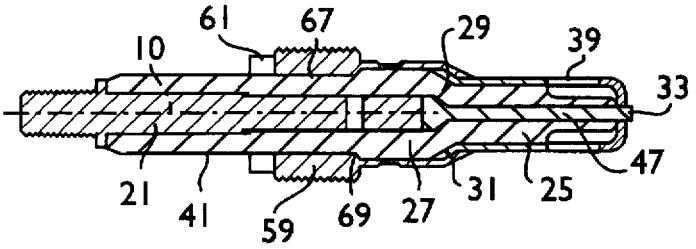
FIG. 3 is a view in cross-section along lines 3—3 of FIG. 1.
Figure 4:
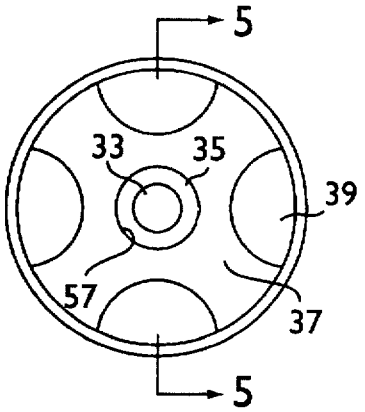
FIG. 4 is a simplified and enlarged end view similar to FIG. 2, but emphasizing the location and spacing of the electrodes
Figure 5:
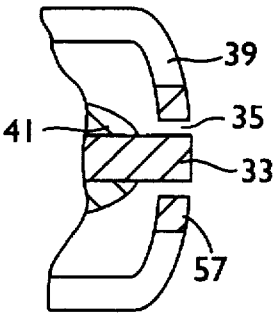
FIG. 5 is a view in cross-section along lines 5—5 of FIG. 4.

A cylindrical shell shaped ground shield 37 surrounds the insulator first diameter section 25 and includes near one end a frustoconical section 31 which is juxtaposed with the insulator shoulder 29. There is a ground electrode 57 near the other end having a portion radially aligned with the center electrode tip 33 as best seen in FIGS. 4 and 5. Tip 33 and ground electrode 57 defining a radial spark gap within the annulus of opening 35. A annular retainer such as the castle head jam screw 59 has a threaded portion 61 surrounding the third insulator section 67 and extends toward the right as viewed to also surround the insulator second diameter section 27. Threaded portion 61, of course, threadedly engages the threaded portion 17 of the generally cylindrical opening. The annular retainer 59 has a sidewall thickness in the region of the threaded portion 61 which is substantially greater than the sidewall thickness in the region overlapping the region 27. The annular retainer 59 has a frustoconical portion 63 overlapping the ground shield frustoconical section 31 and juxtaposed insulator shoulder 29 securing the ground shield and retainer together with the insulator captured therebetween. Finally, the annular retainer includes a second frustoconical portion 71 which engages the shoulder 69. TVs insulator provides a compression transmitting mechanical connection between the retainer 59 and the shield 37 which, when threaded into the engine bore 13, urges the retainer frustoconical portion 31 into engagement with the ground shield frustoconical portion 63 which, in turn, engages the seat portion 19 to establish an electrical ground between the shield and head while at the same time sealing the combustion chamber 15 from the surrounding environment. When the retainer is threaded into the bore, the retainer flange 63 is, of course, also urged into sealing engagement with the bore seat 19.

The embodiment of FIGS. 1–5 illustrates a radial spark gap between the tip 33 and the ground electrode 57. The partially closed end of the ground shield 37 includes a tip receiving centrally located aperture 35 and Fout symmetrically disposed apertures 39. Note, as best seen in FIG. 5, that the insulator 41 is axially spaced from the aperture while the tip 33 extends through the aperture and beyond the end of the shield 37. The ground shield end portion 57 thus radially surrounds the center electrode tip 33 to form the radial spark gap.

FIGS. 6, 10 and 11 illustrate formation of an axial spark gap between the tip 51 and ground contact 55 portion 53. In this embodiment, the ground shield end portion includes a generally U-shaped stirrup 65 which diametrally spans the end shield end and includes an electrode portion 53 which is axially spaced from the center electrode tip 51.

FIG. 6 also illustrates one reason the present invention facilitates spark plug removal as compared to the abovenoted patented designs. There is initially a small gap 49 between the bore 13 sidewall and the outer cylindrical surface of the ground shield 37. As the engine runs, carbon and other combustion deposits tend to fill this annular gap reducing the clearance between the bore and the spark plug. This reduced clearance necessitates the plug be removed directly axially without any tipping. With a jam nut formed separate from the spark plug, such axial removal is nearly impossible and difficulty of removal is the general result. When the jam nut is integral with the remaining spark plug structure, the whole plug is removed in a helical pattern as the nut is unscrewed directly along the axis resulting in negligible tipping and easy removal.

The embodiment of FIGS. 7–9 represents a substantial saving in the cost of the ground shield portion. By welding the L-shaped electrode 73 to an otherwise open-ended cylindrical ground shield portion, the comparatively complex fabrication of the partially closed end is avoided reducing the cost of the ground shield to about 10% of its former value. In this embodiment, the ground shield end portion includes the generally L-shaped member 73 which has a free end 75 radially aligned with and axially spaced from the center electrode tip 77 to form the spark gap.

The unique technique for fabricating a spark plug in accordance with the invention should now be clear. The insulator 41 or 45 and its included center electrode are axially passed into the cylindrical shell ground shield. In the case of the radial spark gap of FIGS. 1–5, this step of axially passing includes moving the center electrode tip 33 through the aperture 35 and to a position axially aligned with and radially spaced from the shield end 57. The flared frustoconical flange 31 engages the insulator shoulder 29. The cylindrical shell retainer 59 is then axially passed over the insulator from the opposite end and its interior frustoconical ledge 71 engages the insulator second shoulder 69. A portion of the retainer is then radially collapsed about the flange 31 to secure the ground shield and retainer together with the insulator captured therebetween.

What is claimed is:

1. A spark plug located in a generally cylindrical opening communicating with a combustion chamber of an internal combustion engine, the opening including a threaded portion and a generally frustoconical seat portion, the spark plug comprising;

a center electrode having a cylindrical body with a tip at one end and a terminal near the other end;

an insulator radially surrounding the center electrode and having a substantially cylindrical body with at least first and second diameter sections separated by a shoulder, the diameter of the second diameter section being greater than the diameter of the first diameter section;

a ground shield surrounding said insulator first diameter section and including near one end a frustoconical section juxtaposed with the insulator shoulder and a ground electrode near the other end having a portion thereof aligned with the center electrode tip and defining therewith a spark gap; and an annular retainer surrounding said insulator second diameter section and including a threaded portion threadedly engaging the threaded portion of the generally cylindrical opening and a frustoconical portion overlapping the ground shield frustoconical section and juxtaposed insulator shoulder securing the ground shield and retainer together with the insulator captured therebetween.

2. The spark plug as recited in claim 1 wherein the ground shield other end portion radially surrounds the center electrode tip.

3. The spark plug as recited in claim 2 wherein the other end portion includes a tip receiving centrally located aperture with the insulator axially spaced from the aperture and the tip extending through the aperture and beyond the end of the shield.

4. The spark plug as recited in claim 1 wherein the ground shield other end portion includes a generally U-shaped stirrup diametrally spanning the end shield other end and axially spaced from the center electrode tip.

5. The spark plug as recited in claim 1 wherein the insulator includes a third diameter section with the second diameter section located intermediate the first and third diameter sections and with the diameter of the second diameter section being greater than the diameter of the third diameter section.

6. The spark plug as recited in claim 5 wherein the insulator further includes a second shoulder separating the second and third diameter sections and the annular retainer includes a second frustoconical portion engaging the second shoulder, the insulator providing mechanical connection between the retainer and the shield urging the retainer frustoconical portion toward the frustoconical seat portion to establish an electrical ground between the shield and head while at the same time sealing the combustion chamber from the surrounding environment.

7. The spark plug as recited in claim 1 wherein the retainer frustoconical portion sealingly engages the frustoconical seat portion.

8. The spark plug as recited in claim 1 wherein the ground shield other end portion includes a generally L-shaped member having a free end radially aligned with and axially spaced from the center electrode tip.

9. The spark plug as recited in claim 1 wherein the annular retainer has a sidewall thickness in the region of the threaded portion which is substantially greater than the sidewall thickness in the region overlapping the ground shield.

10. A spark plug located in a generally cylindrical spark plug receiving bore in an internal combustion engine, the bore communicating with a combustion chamber of the internal combustion engine and including a threaded portion and a generally frustoconical seat portion, the spark plug comprising;

a center electrode having a cylindrical body with a tip at one end and a terminal near the other end;

an insulator radially surrounding the center electrode and having a substantially cylindrical body with at least first and second diameter sections separated by a shoulder, the diameter of the second diameter section being greater than the diameter of the first diameter section;

a ground shield surrounding said insulator first diameter section and including near one end a frustoconical section juxtaposed with the insulator shoulder and a ground electrode near the other end having a portion including a tip receiving centrally located aperture radially aligned with the center electrode tip and defining therewith a spark gap; and an annular retainer surrounding said insulator second diameter section and including a portion having threads that are matched with the bore threads, the annular retainer providing a seal between the ground shield frustoconical section and the frustoconical seat portion of the bore to establish an electrical ground between the shield and head while at the same time sealing the combustion chamber from the surrounding environment.

11. The spark plug as recited in claim 10 wherein the insulator is axially separated from the tip receiving aperture and the tip extends through the aperture and beyond the end of the shield.

12. The spark plug as recited in claim 10 wherein the annular retainer includes a frustoconical portion overlapping the ground shield frustoconical section and juxtaposed insulator shoulder.

13. The spark plug as recited in claim 12 wherein the insulator includes a third diameter section with the second diameter section located intermediate the first and third diameter sections and with the diameter of the second diameter section being greater than the diameter of the third diameter section.

14. The spark plug as recited in claim 13 wherein the insulator further includes a second shoulder separating the second and third diameter sections and the annular retainer includes a second frustoconical portion engaging the second shoulder securing the ground shield and retainer together with the insulator captured therebetween.

15. The spark plug as recited in claim 10 wherein the annular retainer has a sidewall thickness in the region of the threaded portion which is substantially greater than the sidewall thickness in the region overlapping the ground shield.

16. The method of fabricating a spark plug of the type having a center electrode with a tip at one end and a terminal near the other end and an insulator radially surrounding the center electrode, the insulator having a substantially cylindrical body with at least first and second diameter sections separated by a first shoulder, and second and third diameter sections separated by a second shoulder where the diameter of the second section is greater than the diameters of the first and third sections comprising:

axially passing a cylindrical shell ground shield of the type having a ground electrode near one end and a flared frustoconical flange near the other over the first diameter section to engage the flared frustoconical flange with the first shoulder;

axially passing a cylindrical shell retainer of the type having an interior frustoconical ledge and exterior threads over both the third and second diameter sections to engage the frustoconical ledge with the second shoulder; and radially collapsing a portion of the retainer about the flared frustoconical flange to secure the ground shield and retainer together with the insulator captured therebetween.

17. The method of claim 16 wherein the ground electrode includes a centrally located tip receiving aperture, the step of axially passing including moving the center electrode tip through the aperture and to a position axially aligned with and radially spaced from the shield one end to form therebetween a radial spark gap.

18. A spark plug comprising:

an elongated center electrode;

an insulator disposed radially around said elongated center electrode having a first diameter section separated by a first shoulder from a second diameter section and a third diameter section separated by a second shoulder from the second diameter section with the second diameter section located intermediate the first and third diameter sections and the diameter of the second section being greater than the diameters of the first and third diameter sections;

a cylindrical ground shield, having a ground electrode on one end and a flange on the other end, disposed around the first diameter section with the flange engaging the first shoulder; and, a cylindrical retainer disposed around the third diameter section and the second diameter section including an internal portion which engages the second shoulder and an end portion which engages said cylindrical ground shield near the first shoulder to capture said insulator therebetween.

19. A spark plug as claimed in claim 18 wherein:

said elongated center electrode has a terminal on one end and a tip on the other end to define a spark gap with respect to the ground electrode; and, said cylindrical retainer has another end portion which has external threads.

20. A spark plug as claimed in claim 19 wherein said ground electrode is L-shaped having a free end radially aligned with and axially spaced from the center electrode tip.

21. A spark plug as claimed in claim 19 wherein said ground electrode is generally a U-shaped stirrup diametrically spanning the free end of said ground shield and axially spaced from the center electrode tip.

22. A spark plug as claimed in claim 19 wherein said ground electrode spans the free end of said ground shield and includes an opening near the center electrode tip to define a radial spark gap between the sides of the opening and the center electrode tip.

* * * * *